US007087526B1

(12) United States Patent
Zhuang et al.

(10) Patent No.: US 7,087,526 B1
(45) Date of Patent: Aug. 8, 2006

(54) METHOD OF FABRICATING A P-TYPE CAO-DOPED $SRCU_2O_2$ THIN FILM

(75) Inventors: Wei-Wei Zhuang, Vancouver, WA (US); Wei Gao, Vancouver, WA (US); Yoshi Ono, Camas, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 0 days.

(21) Appl. No.: 11/261,020

(22) Filed: Oct. 27, 2005

(51) Int. Cl.
*H01L 23/02* (2006.01)

(52) U.S. Cl. ..... 438/681; 438/782; 438/E51.022; 257/79

(58) Field of Classification Search ..... 438/608, 438/681, 780–782; 257/79
See application file for complete search history.

(56) References Cited

U.S. PATENT DOCUMENTS 6,914,268 B1 * 7/2005 Shei et al. ..... 257/99

OTHER PUBLICATIONS

Ohta et al., *Fabrication and Current Injection UV-light Emission from a transparent p-n Heterojunction Composed of p-$SrCu_2O_2$ and n-ZnO*, Key Engineering Materials, vol. 214-215 pp. 75-80 (2002).
Martinson, *Synthesis of Single Phase $SrCu_2O_2$ from liquid precursors*, Journal of Young Investigators, vol. 10, Issue 3, Mar. 2004.
Nie et al., *First-principles study of transparent p-type conductive $SrCu_2O_2$ and related compounds*, Physical Review B, vol. 65, 2002, pp. 075111.

* cited by examiner

*Primary Examiner*—Quoc Hoang
(74) *Attorney, Agent, or Firm*—Robert D. Varitz, PC

(57) ABSTRACT

A method of CaO-doped $SrCu_2O_2$ spin-on precursor synthesis and low temperature p-type thin film deposition, includes preparing a wafer to receive a spin-coating thereon; selecting metalorganic compounds to form a $SrCu_2O_2$ precursor, mixing and refluxing the metalorganic compounds to form a precursor mixture; filtering the precursor mixture to produce a spin-coating precursor; applying the spin-coating precursor to the wafer in a two-step spin coating procedure; baking the spin-coated wafer using a hot-plate bake to evaporate substantially all of the solvents; and annealing the spin-coated wafer to form a CaO-doped $SrCu_2O_2$ layer thereon.

15 Claims, 1 Drawing Sheet

METHOD OF FABRICATING A P-TYPE CAO-DOPED $SRCU_2O_2$ THIN FILM

FIELD OF THE INVENTION

This invention relates to the synthesis of a calcium-doped $SrCu_2O_2$ (SCO) spin-on precursor solution and the deposition of corresponding thin films, which have p-type conductivity and which may be used with ZnO thin films for fabricating light emitting devices.

BACKGROUND OF THE INVENTION

For the purpose of generating a pn junction for use in the fabrication of a light emitting diode, ZnO is an excellent material having n-type characteristics, which generates near UV light, at about 380 nm. A corresponding p-type material is required to complete the pn structure. Currently, candidate p-type materials include Cu(I) based oxides, such as $SrCu_2O_2$, $AlCuO_2$ and $GaCuO_2$. In 2002, Ohta et al., *Fabrication and Current Injection UV-light Emission from a transparent p-n Heterojunction Composed of p-$SrCu_2O_2$ and n-ZnO*, Key Engineering Materials, Vol. 214–215 (2002) pp. 75–80, reported the fabrication of pn heterojunctions of p-$SrCu_2O_2$ and n-ZnO, using a pulsed laser ablation deposition technique. The integration of films includes single crystal yittria-stabilized zirconia $ZrO_2$ (YSZ) as the substrate, indium-tin-oxide (ITO) as a transparent n-type electrode, and the combination of n-type ZnO and p-type $SrCu_2O_2$ for the pn junction, and a thin nickel film as the top electrode. From this structure, electroluminescence was observed.

Also in 2002, Martinson, *Synthesis of Single Phase $SrCu_2O_2$ from liquid precursors*, Journal of Young Investigators, Vol. 10. Issue 3, March 2004, reported the synthesis of single phase $SrCu_2O_2$ from water based liquid precursors using a spray technique, however, there is no mention of the integration of n-type ZnO and p-$SrCu_2O_2$ in this publication.

To our knowledge, there are no reports on the preparation of a strong p-type calcium-doped $SrCu_2O_2$ thin film via spin-coating process. Nie et al., *First-principles study of transparent p-type conductive $SrCu_2O_2$ and related compounds*, Physical Review B, Vol. 65, 2002, pp 075111, reported theoretical studies on the electrical properties of $[Sr_{1-x}Ca_x]Cu_2O_2$, and stated that they expected the best p-type properties for compositions where x=0.16. There were no experimental data to support their studies.

In our prior filed patent application Ser. No. 11/220,885, filed Sep. 6, 2005, for *Method of $SrCu_2O_2$ spin-on precursor synthesis and low temperature p-type thin film deposition*, we disclosed a stable spin-on precursor. This work describes a stable, spin-on precursor having a calcium acetate component which provides for a higher quality thin film forming a pn junction.

SUMMARY OF THE INVENTION

A method of CaO-doped $SrCu_2O_2$ spin-on precursor synthesis and low temperature p-type thin film deposition, includes preparing a wafer to receive a spin-coating thereon; selecting metalorganic compounds to form a $SrCu_2O_2$ precursor, mixing and refluxing the metalorganic compounds to form a precursor mixture; filtering the precursor mixture to produce a spin-coating precursor; applying the spin-coating precursor to the wafer in a two-step spin coating procedure; baking the spin-coated wafer using a hot-plate bake to evaporate substantially all of the solvents; and annealing the spin-coated wafer to form a CaO-doped $SrCu_2O_2$ layer thereon.

It is an object of the invention to synthesize a stable calcium-doped SCO spin-on precursor which can be used for the fabrication of p-type SCO thin films via a spin coating process.

Another object of the invention is to provide p-type conductivity using a low temperature annealing process.

A further object of the invention is to provide calcium-doped SCO thin films which are integratable with n-type ZnO thin films.

This summary and objectives of the invention are provided to enable quick comprehension of the nature of the invention. A more thorough understanding of the invention may be obtained by reference to the following detailed description of the preferred embodiment of the invention in connection with the drawings.

DETAILED DESCRIPTION OF THE PREFERRED EMBODIMENTS

Figure 1:
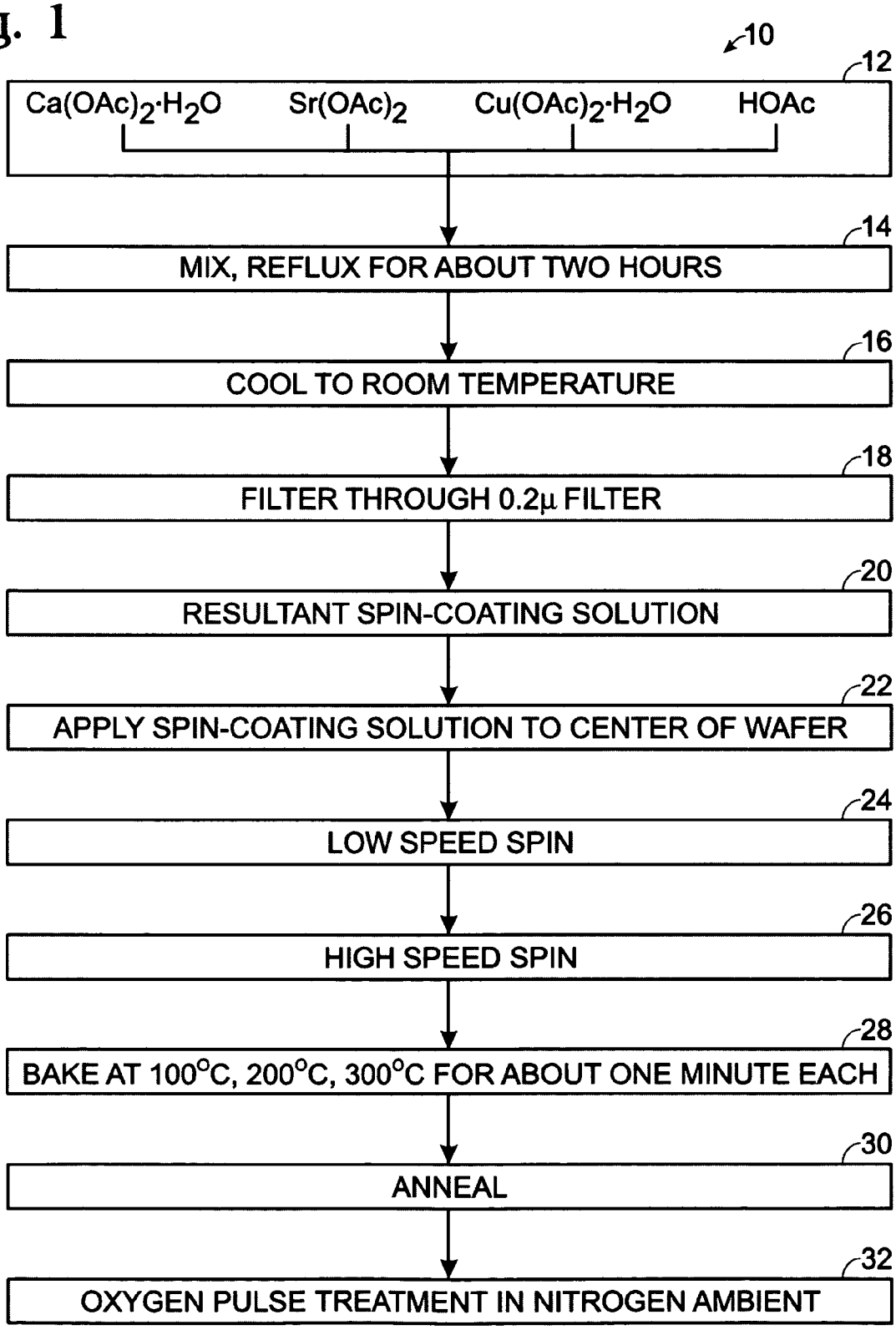
FIG. 1 is a block diagram depicting the steps of the method of the invention.

A stable $SrCu_2O_2$ (SCO) spin-on precursor, doped with high concentration of calcium, has been successfully developed, which may be used for the fabrication of a p-type doped SCO thin film via a spin coating process. To obtain p-type conductivity, a process has been developed which results in a stable precursor, i.e., one which is viable at room temperature storage for about a week. SCO thin films fabricated with the precursor of the method of the invention have been integrated with n-type ZnO thin films produced via atomic layer deposition (ALD), sputtering and metal organic deposition (MOD) methods. The method of the invention for the fabrication of strong p-type CaO-doped $SrCu_2O_2$ thin films includes a spin-coating technique.

The precursor solution is prepared by using acetates of metals, such as Ca, Sr and Cu and using acetic acid as an organic solvent. After spinning the solution onto a wafer surface, the thin film is initially baked, seriatim, at 100°, 200° and 300° C. for about one minute at each temperature. This step is followed by an rapid thermal anneal (RTA) treatment at between about 400° C. to 700° C. for between about five to 20 minutes in forming gas ambient. A final oxygen pulse treatment at between about 300° C. to 600° C. for between about one to 60 seconds in nitrogen ambient resulted in a thin film having strong p-type properties, as determined by Hall measurements.

The method of the invention for forming a calcium-doped $SrCu_2O_2$ spin-coating precursor synthesis procedure and thin film fabrication therefrom is shown in FIG. 1, generally at 10. The doping concentration ranges from between about 1 mol % to 20 mol %. Metalorganic compounds are used as the starting chemicals, which are calcium acetate monohydrate ($Ca(OAc)_2.H_2O$, where OAc is acetate), strontium acetate ($Sr(OAc)_2$) and copper(II) acetate monohydrate ($Cu(OAc)_2.H_2O$). Acetic acid (HOAc) is used as the solvent, 12. After refluxing for at least two hours 14, the solution is cooled to room temperature 16, and filtered through a 0.2 μm filter 18 for purification. The precursor so produced 20 is stable for about one week, and may be used for p-type CaO-doped $SrCu_2O_2$ thin films fabrication. In the case where a solid precipitates from the precursor solution, the solution may be re-purified by heating at about 120° C. about two hours, and again filtering through a 0.2 μm filter.

The SCO thin film spin-coating includes initially preparing a wafer and spreading the precursor solution on the wafer surface 22 uniformly at a slow spin speed 24 of between about 100 rpm to 500 rpm for between about 5 to 10 seconds, and then accelerating the spin speed to a fast spin speed 26 of between about 1000 rpm to 8000 rpm for between about 30 seconds to 90 seconds. The fresh coated thin film is baked, successively, over three hot plates at the temperatures of 100° C., 200° C. and 300° C., respectively, for one minute at each temperature 28 to evaporate substantially all of the solvents. Following the baking step, a single RTA step is performed at temperatures ranging from between about 400° C. to 700° C. for between about five minutes to twenty minutes in forming gas ambient 30. The final processing step is an oxygen pulse treatment in nitrogen ambient 32. The pulse duration time ranges from between about one second to 60 seconds, and the pulse temperatures ranges from between about 300° C. to 600° C., thus producing a CaO-doped $SrCu_2O_2$ thin film, which demonstrates strong p-type properties.

The produced doped $SrCu_2O_2$ thin films may be integrated with n-type ZnO thin films via ALD, sputtering or MOD process for the fabrication of EL photonic devices in pn junction structures.

EXAMPLE 1

$Ca(C_2H_3O_2)_2.H_2O$ (0.6076 gram, 0.0345 mol), $Sr(C_2H_3O_2)_2$ (1.4778 gram, 0.0718 mol) and $Cu(C_2H_3O_2)_2.H_2O$ (2.8685 gram, 0.1437 mol) were mixed and added into a 100 mL flask containing 100 mL acetic acid. The solution was refluxed for two hours and then cooled to room temperature. After filtering through a 0.2 μm filter, the solution obtained was used for the CaO-doped SCO thin film deposition via spin-coating process.

The solution (about 2 mL) was applied onto the center of a wafer surface, e.g., a 6" p-type test wafer, via a pipette, and then spread cover the whole wafer at a spin rate of 300 rpm for five seconds. The thin film was formed at the spin rate of 2000 rpm for 60 seconds, and then hot-plate baked, seriatim, at 100° C., 200° C. and 300° C. for one minute at each temperature. The thin film was then treated by RTA at 650° C. for ten minutes in forming gas ambient, and then followed by an oxygen pulse treatment in nitrogen ambient. The temperature of oxygen pulse was 350° C., and duration time was 10 seconds.

The resultant thin film showed strong p-type characterization. The results of the hale measurement were shown in Table 1:

TABLE 1

| Carrier Type | Resistivity | Hall Mobility | Carrier Concentration |
|---|---|---|---|
| Hole | 100–500 μΩ-cm | 200–400 $cm^2/Vs$ | $3 \times 10^{19}$–$2 \times 10^{20}$ $cm^{-3}$ |

Thus, a method of fabricating a p-type calcium-doped $SrCu_2O_2$ thin film has been disclosed. It will be appreciated that further variations and modifications thereof may be made within the scope of the invention as defined in the appended claims.

We claim:

1. A method of calcium-doped $SrCu_2O_2$ spin-on precursor synthesis and low temperature p-type thin film deposition, comprising:

preparing a wafer to receive a spin-coating thereon;

selecting metalorganic compounds to form a CaO-doped $SrCu_2O_2$ precursor includes selecting calcium acetate monohydrate ($Ca(OAc)_2.H_2O$, where OAc is acetate), strontium acetate ($Sr(OAc)_2$) and copper(II) acetate monohydrate ($Cu(OAc)_2.H_2O$), and acetic acid (HOAc) as a solvent;

mixing and refluxing the selected metalorganic compounds to form a precursor mixture having solvents therein;

filtering the precursor mixture to produce a spin-coating precursor;

applying the spin-coating precursor to the wafer in a two-step spin coating procedure, including:

spin coating the wafer at a first, slow spin speed; and spreading the spin-coating precursor on the wafer at a second, higher spin speed;

baking the spin-coated wafer using a hot-plate bake to evaporate substantially all of the solvents; and annealing the spin-coated wafer to form a CaO-doped $SrCu_2O_2$ layer thereon.

2. The method of claim 1 wherein mixing and refluxing the selected metalorganic compounds includes refluxing the precursor mixture for about two hours; and cooling the precursor mixture to room temperature.

3. The method of claim 1 wherein said spin coating the wafer at a first, slow spin speed includes spin coating the wafer at a first, uniform spin speed of between about 100 rpm and 500 rpm for between about five seconds to ten seconds.

4. The method of claim 1 wherein said spreading the spin-coating precursor on the wafer at a second, higher spin speed includes spreading the spin-coating precursor on the wafer at a speed of between about 1000 rpm and 8000 rpm for between about 30 seconds to 90 seconds.

5. The method of claim 1 wherein said baking the spin-coated wafer using a hot-plate bake to evaporate substantially all of the solvents includes a three-step baking procedure, wherein a first bake step is done at a temperature of about 100° C. for about one minute, wherein the second bake step is done at a temperature of about 200° C. for about one minute, and wherein a third bake step is done at a temperature of about 300° C. for about one minute.

6. The method of claim 1 wherein said annealing the spin-coated wafer to form a CaO-doped $SrCu_2O_2$ layer thereon includes rapid thermal annealing the spin-coated wafer in forming gas in at a temperature in a range of between about 400° C. to 700° C. for between about five minutes to twenty minutes.

7. A method of CaO-doped $SrCu_2O_2$ spin-on precursor synthesis and low temperature p-type thin film deposition, comprising:

preparing a wafer to receive a spin-coating thereon;

mixing and refluxing metalorganic compounds to form a CaO-doped $SrCu_{202}$ precursor, including mixing and refluxing calcium acetate monohydrate ($Ca(OAc)_2.H_2O$, where OAc is acetate), strontium acetate ($Sr(OAc)_2$) and copper(II) acetate monohydrate ($Cu(OAc)_2.H_2O$), and acetic acid (HOAc) as a solvent, to form a precursor mixture;

filtering the precursor mixture to produce a spin-coating precursor;

applying the spin-coating precursor to the wafer in a two-step spin coating procedure, including:

spin coating the wafer at a first, uniform spin speed of between about 100 rpm to 500 rpm for between about five seconds to ten seconds; and spreading the spin-coating precursor on the wafer at a second, higher spin speed of between about 1000 rpm and 8000 for between about 30 seconds to 90 seconds;

baking the spin-coated wafer using a hot-plate bake to evaporate substantially all of the solvent; and annealing the spin-coated wafer to form a CaO-doped $SrCu_2O_2$ layer thereon.

8. The method of claim 7 wherein mixing and refluxing the selected metalorganic compounds includes refluxing the precursor mixture for about two hours; and cooling the precursor mixture to room temperature.

9. The method of claim 7 wherein said baking the spin-coated wafer using a hot-plate bake to evaporate substantially all of the solvents includes a three-step baking procedure, wherein a first bake step is done at a temperature of about 100° C. for about one minute, wherein the second bake step is done at a temperature of about 200° C. for about one minute, and wherein a third bake step is done at a temperature of about 300° C. for about one minute.

10. The method of claim 7 wherein said annealing the spin-coated wafer to form a CaO-doped $SrCu_2O_2$ layer thereon includes rapid thermal annealing the spin-coated wafer in forming gas in at a temperature in a range of between about 400° C. to 700° C. for between about five minutes to twenty minutes.

11. A method of CaO-doped $SrCu_2O_2$ spin-on precursor synthesis and low temperature p-type thin film deposition, comprising:

preparing a wafer to receive a spin-coating thereon;

selecting metalorganic compounds to form a CaO-doped $SrCu_2O_2$ precursor, including selecting calcium acetate monohydrate ($Ca(OAc)_2.H_2O$, where OAc is acetate), strontium acetate ($Sr(OAc)_2$) and copper(II) acetate monohydrate ($Cu(OAc)_2.H_2O$), and acetic acid (HOAc) as a solvent, to form a precursor mixture;

mixing and refluxing the selected metalorganic compounds to form a precursor mixture;

adding ethanolamine to the precursor mixture;

filtering the precursor mixture to produce a spin-coating precursor;

applying the spin-coating precursor to the wafer in a two-step spin coating procedure, including:

spin coating the wafer at a first, slow spin speed; and spreading the spin-coating precursor on the wafer at a second, higher spin speed;

baking the spin-coated wafer using a hot-plate bake to evaporate substantially all of the solvents; and annealing the spin-coated wafer to form a CaO-doped $SrCu_2O_2$ layer thereon by rapid thermal annealing of the spin-coated wafer in forming gas in at a temperature in a range of between about 400° C. to 700° C. for between about five minutes to twenty minutes.

12. The method of claim 11 wherein mixing and refluxing the selected metalorganic compounds includes refluxing the precursor mixture for about two hours; and cooling the precursor mixture to room temperature.

13. The method of claim 11 wherein said spin coating the wafer at a first, slow spin speed includes spin coating the wafer at a first, uniform spin speed of between about 100 rpm and 500 rpm for between about five seconds to ten seconds.

14. The method of claim 11 wherein said spreading the spin-coating precursor on the wafer at a second, higher spin speed includes spreading the spin-coating precursor on the wafer at a speed of between about 1000 rpm and 8000 rpm for between about 30 seconds to 90 seconds.

15. The method of claim 11 wherein said baking the spin-coated wafer using a hot-plate bake to evaporate substantially all of the solvents includes a three-step baking procedure, wherein a first bake step is done at a temperature of about 100° C. for about one minute, wherein the second bake step is done at a temperature of about 200° C. for about one minute, and wherein a third bake step is done at a temperature of about 300° C. for about one minute.

* * * * *